US007212646B2

(12) United States Patent
Nassimi

(10) Patent No.: US 7,212,646 B2
(45) Date of Patent: May 1, 2007

(54) ADJUSTABLE EAR CANAL RETENTION TRANSCEIVER/RECEIVER

(76) Inventor: Shary Nassimi, 29670 Harvester, Malibu, CA (US) 90265

( * ) Notice: Subject to any disclaimer, the term of this patent is extended or adjusted under 35 U.S.C. 154(b) by 0 days.

(21) Appl. No.: 10/908,715

(22) Filed: May 24, 2005

(65) Prior Publication Data

US 2005/0250559 A1 Nov. 10, 2005

Related U.S. Application Data

(63) Continuation-in-part of application No. 10/261,367, filed on Sep. 30, 2002, now Pat. No. 6,922,476.

(51) Int. Cl.
*H04R 25/00* (2006.01)

(52) U.S. Cl. ..... 381/380; 381/392

(58) Field of Classification Search ..... 381/322, 381/325, 328, 380, 382, 390; 379/430, 431; 455/569.1, 575.1, 575.2, 575.5, 575.8
See application file for complete search history.

(56) References Cited

U.S. PATENT DOCUMENTS

RE26,258 E * 8/1967 Martin ..... 381/328
6,574,345 B1 * 6/2003 Huang ..... 381/380

* cited by examiner

*Primary Examiner*—Sinh Tran
*Assistant Examiner*—Brian Ensey
(74) *Attorney, Agent, or Firm*—Bond, Schoeneck & King, PLLC

(57) ABSTRACT

The present invention is a wireless headset having a removable compliant polymer sheath that is retained in the ear of a user via friction. The wireless headset is reduced in size to earpiece, in which the comfort and sanitation of the user and the life span of the device may in increased by providing a replaceable compliant polymer sheath for the sound tube which is inserted into the ear canal. In alternative embodiments, the sheath and ear canal may mechanically cooperate to retain the wireless headset in the ear canal. The sheath may be easily removed and replaced so as to adapt the length and diameter of the device for the needs and comfort of different users, allow safe and sanitary use of one wireless device by more than one user, and allow for easy repairs and refurbishments.

7 Claims, 5 Drawing Sheets

ADJUSTABLE EAR CANAL RETENTION TRANSCEIVER/RECEIVER

CROSS REFERENCE TO RELATED APPLICATION

The present application is a continuation-in-part application of Applicant's U.S. application Ser. No. 10/261,367, filed on Sep. 30, 2002 now U.S. Pat. No. 6,922,476.

FIELD OF THE INVENTION

This invention relates generally to wireless headsets and more specifically to a transceiver/receiver headset with an adjustable in-ear friction retainer sheath.

BACKGROUND OF THE INVENTION

Wireless headsets provide greater convenience and safety to the users of such devices as cell phones, by allowing the user partially or completely hands free operation of the cell phone. Such headsets normally comprise some sort of head band or ear clip to retain the headset in the proper position, a microphone located near the mouth, and such wireless equipment as is necessary to communicate with a base unit located at or on the cell phone or similar device.

However, the comfort and convenience of the wireless headset may be reduced by the method of maintaining the headset in position on the user's head. Head bands which cross over the top of the head quickly become uncomfortable and may slip out of position. Ear clips also suffer from the problem of discomfort. Various types of headsets exist which illustrate these difficulties.

U.S. Pat. No. 4,882,745 issued Nov. 21, 1989 to Silver for "CORDLESS HEADSET TELEPHONE" shows one early telephone headset in the context of a conventional land-line telephone. The headset disclosed has a large ear piece, telescoping antennas in both base unit and headset, and a cross section so large as to include a keypad on the headset portion of the device. The headset also includes on/off switches and a manual volume control. The size of this headset is notable.

U.S. Pat. No. 5,590,417 issued Dec. 31, 1996 to Rydbeck for "RADIOTELEPHONE APPARATUS INCLUDING A WIRELESS HEADSET" teaches a headset in which recharging is accomplished when the headset is attached to the base transceiver unit. Two embodiments are taught in both of which manual control of headset output volume is accomplished manually at the base transceiver unit. The wired version of the unit is small but the wireless version appears to be almost as large as the original cell phone, somewhat defeating the intent of the device.

U.S. Pat. No. 5,790,684 issued Aug. 4, 1988 to Niino et al for "TRANSMITTER/RECEIVING APPARATUS FOR USE IN TELECOMMUNICATIONS" teaches a multiplicity of earphones (connected by wire 17 and similar wires) which are wired to a cell phone. It is small, wired, and does not appear to provide any means of adapting to the ear sizes of different users or assuring comfortable and sanitary operation.

U.S. Pat. No. 5,933,506 issued Aug. 3, 1999 to Aoki et al for "TRANSMITTER-RECEIVER HAVING EARPIECE TYPE ACOUSTIC TRANSDUCING PART" teaches a non-wireless headset with an earpiece connected thereto. It is small, wired, and does not appear to provide any means of adapting to the ear sizes of different users or assuring comfortable and sanitary operation.

U.S. Pat. No. 6,078,825 issued Jun. 20, 2000 to Hahn et al. for "MODULAR WIRELESS HEADSET SYSTEM FOR HANDS FREE TALKING" and U.S. Pat. No. 6,230,029 B1 issued May 8, 2001 to Hahn et al. for "MODULAR WIRELESS HEADSET SYSTEM" disclose a headset having battery contacts used to charge the removable battery pack module. These patents also teach that the headset have manual on/off, channel and volume controls. The unit is nicely streamlined but uses a bulky ear clip and a long microphone tube which together probably render it somewhat heavy and uncomfortable.

U.S. Pat. No. 6,228,020 issued May 8, 2001 to Juneau et al for "COMPLIANT HEARING AID" comes from the technical field of hearing aid design, not wireless headset design. It teaches a hearing aid having a soft polymeric body covering the part inserted into the ear. This provides comfort and convenience to the sole owner, however, sharing of hearing aids is extremely uncommon, and thus no provision is made for adjusting the size of the unit to different users, for sanitation, for replacement of the body when it is worn out.

U.S. Pat. No. 6,415,034 issued Jul. 2, 2002 to Hietanen for "EARPHONE UNIT AND A TERMINAL DEVICE" discloses a small unit which is mounted in the external ear by means of a lug in the ear canal. It does not appear to provide any means of adapting to the ear sizes of different users or assuring comfortable and sanitary operation.

Finally, U.S. patent application Publication No. US 2001/0016506 A1 published Aug. 23, 2001 in the name of Son et al. and entitled "WIRELESS HANDS-FREE SYSTEM OF CELLULAR PHONE" teaches a battery operated hands free headset having a battery saving feature. No indication of any means of charging of the battery is disclosed and requires a switch on the headset that is operated by the user. The device is smaller than most of the prior art devices but still appears to be larger than the user's ear and required a clip for attachment thereto.

It is an object and advantage of the present invention to provide a wireless headset that is dimensioned and configured for comfortable use.

It is a further object and advantage of the present invention to provide a wireless headset that is maintained on the ear of the user via frictional forces.

It is another object and advantage of the present invention to provide a wireless headset having a detachable sheath for adapting the device to the needs and comfort of different users, allowing safe and sanitary use of one wireless device by more than one user, and allowing for easy repairs and refurbishments.

Other objects and advantages of the present invention will in part be obvious, and in part appear hereinafter.

SUMMARY OF THE INVENTION

While previous wireless headsets teach a retainer for the device that may be a headband or ear clip, the wireless headset of the present invention comprises a retainer in the form of a removable compliant polymer sheath. The wireless headset of the present invention is also reduced in size to an earpiece, in which the comfort and sanitation of the user and the life span of the device may in increased by providing a replaceable compliant polymer sheath for the sound tube which is inserted into the ear canal. Friction between the ear canal and the sheath retains the wireless headset in the ear canal. In alternative embodiments, the sheath and ear canal may mechanically cooperate to retain the wireless headset in the ear canal. The sheath may be easily removed and replaced so as to adapt the length and diameter of the device for the needs and comfort of different users. In addition, the replaceable polymer sheath allows safe and sanitary use of one wireless device by more than one user. In addition, polymers are notorious for becoming oxidized and then hard and brittle, however the device of the invention need not be refurbished for this reason since the compliant polymer sheath may be easily removed and replaced whenever required.

DETAILED DESCRIPTION

Figure 1:
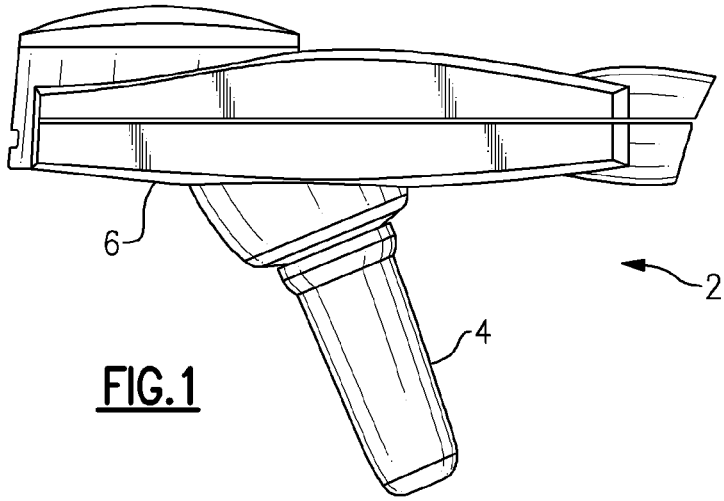
FIG. 1 is a side view of a wireless headset embodying the sheath of the preferred embodiment of the invention.
Figure 2:
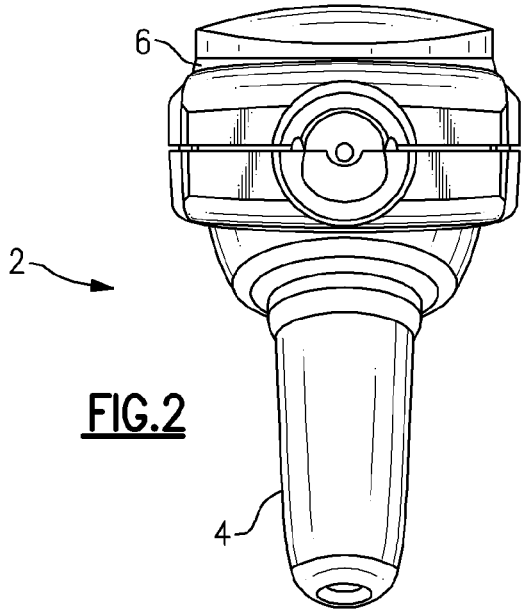
FIG. 2 is an end view of the wireless headset of the first embodiment shown in FIG. 1.
Figure 3:
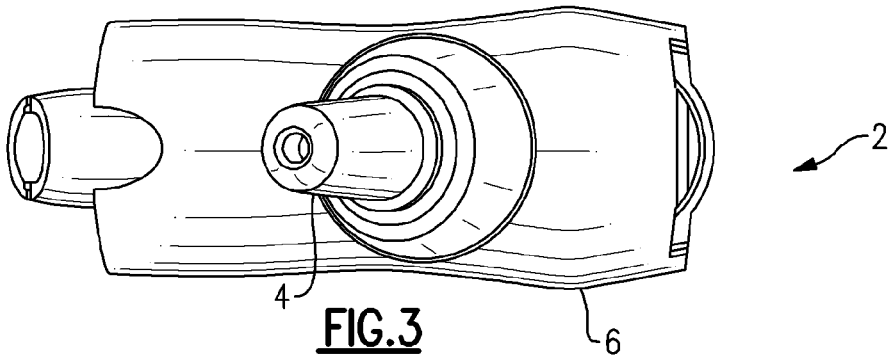
FIG. 3 is a bottom view of the wireless headset of the first embodiment shown in FIG. 1.

Referring now to the drawings, wherein like numerals refer to like parts throughout, there is seen in FIGS. 1–3, a wireless headset 2 according to the present invention comprises a sheath 4 interconnected to a headset body 6. Sheath 4 is dimensioned to fit into the ear canal (not pictured) of a user. The ear canal is any and all of that small cavity leading from the outer ear to the inner ear. Friction between the interior of sheath 4 and the headset body 6 retains sheath 4 in place on wireless headset 2, and friction between the exterior of sheath 4 and the ear canal of the user retains headset body 6 of wireless headset 2 in place.

As used herein, the term "sheath" is used to refer to any removable covering used to cover a projection into the ear canal, regardless of the shapes of the ear canal or projection. While sheath 4 is a compliant polymer material, headset body 6 may be a relatively more rigid construction such as plastic, metal or another more rigid polymer.

Sheath 4 allows the wireless headset to be miniaturized greatly as no headband or ear clip retainers are necessary. Sheath 4 will also suffice to comfortably hold in place the super miniaturized headset for long periods of time, unlike large headsets having such forms of retainers. Unlike prior art ear pieces which rely on friction directly between the sound tube and the ear canal, sheath 4 of the wireless headset of the present invention maintains an adequate comfort level. The present invention thus has a removable and replaceable sheath over a permanent, more rigid body (i.e., the sound tube).

Figure 4:
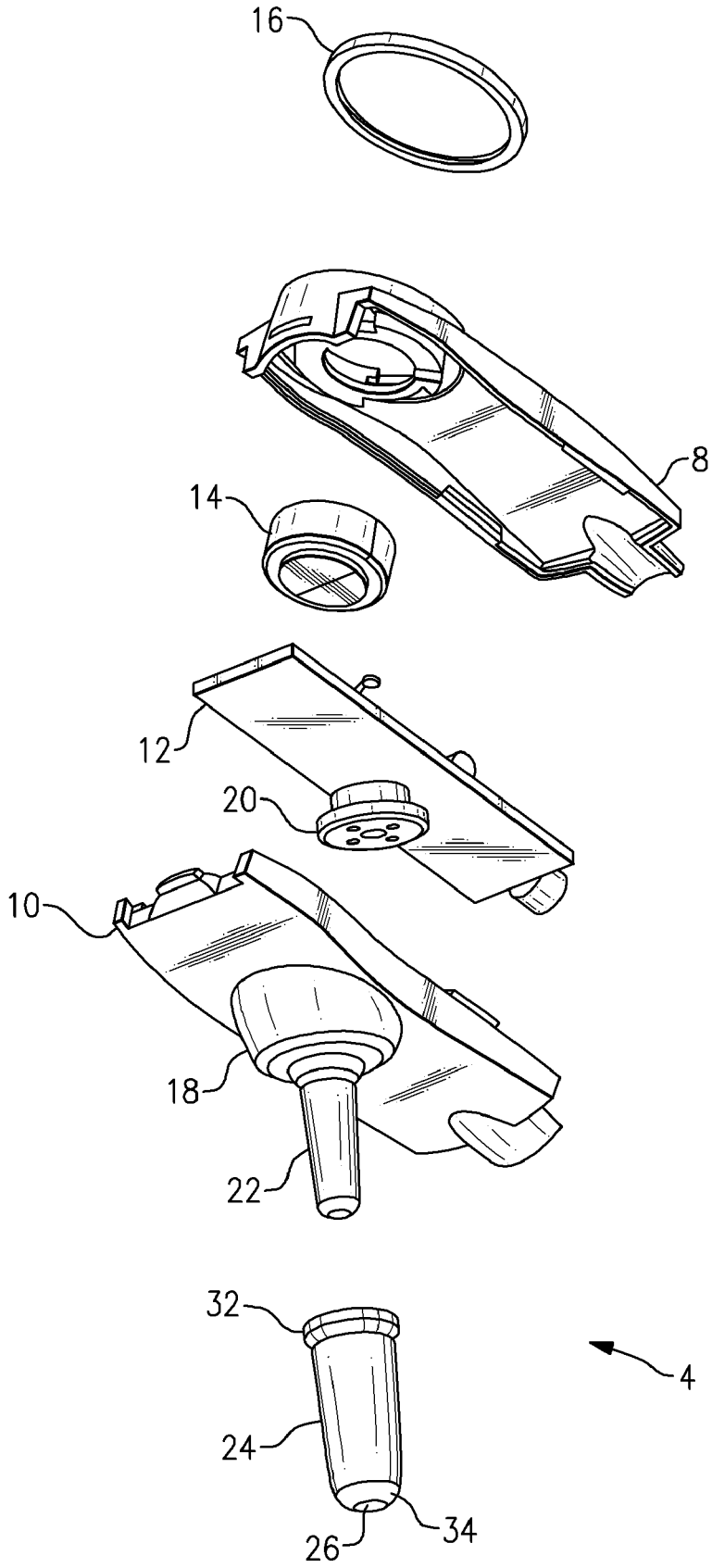
FIG. 4 is an exploded perspective view of the wireless headset of the first embodiment shown in FIG. 1.

Referring to FIG. 4, wireless headset 2 further comprises an upper body 8, a lower body 10, and circuitry 12 disposed in between. In the preferred embodiment, circuitry 12 comprises a printed circuit board with silicon electronic components thereon. A battery 14 provides electrical power and may be changed by removing a cap 16 permitting access into upper body 8. While battery 14 is below upper body 8 in FIG. 4, it should be evident to those of skill in the art that battery 14 may also be above or at co-elevation therewith.

Wireless headset 2 may additionally include either a receiver or a transceiver allowing both reception and transmission. In receiver embodiments, it may be utilized to carry an audio signal in a passive mode, for example a broadcast radio signal or a signal received from a broadcast unit which itself receives the audio signal from a source such as a television set or radio. In transceiver embodiments, the wireless headset may be used in conjunction with a cell phone or similar device to provide true hands free operation without a wire, a bulky headset having an ear clip or head band, and yet with increased comfort and sanitary benefits to the wearer.

A speaker housing 18 contains mini-speaker 20 that may be sized, selected and arranged so as to minimize power drain upon battery 14. By use of sheath 4, wireless headset 2 is maintained in very close position to the ear drum of the user, thus minimizing the drive current needed for mini-speaker 20. In addition, the configuration of speaker housing 18 includes a sound tube 22, which projects into the ear canal of the wearer, thereby directing sound precisely at the ear drum of the user and potentially bringing mini-speaker 20 even closer to the ear drum in alternative embodiments. In general, any such projection into the ear canal will be referred to herein as a "sound tube." Sound tube 22 configuration may vary a good deal in size, shape, form and substance, i.e., it may be entirely rigid, semi-rigid, it may be cylindrical, generally cylindrical, irregular, fitted to the ear or another shape. Sound tube 22 will usually have therein either a speaker or an aperture, grill, mesh or other device to allow sound to pass from mini-speaker 20 in sound tube 22 or wireless headset body 6 to the ear canal of the user. The aperture in sound tube 22 is preferably aligned with an aperture 26in sheath 4 when sheath 4 is disposed upon the sound tube 22. Thus, a smaller speaker, smaller battery and smaller unit are permitted by the invention, thus furthering the convenience of the user. Mini-speaker 20 may be a peizo-electric device, a button speaker, or another type of speaker.

Sheath 4 is generally cylindrical in the drawings and preferably has a slightly conical exterior sheath configuration. In alternative embodiments, sheath 4 may be more sharply conical in exterior sheath configuration, may be a true cylinder, may be an ogive shape, a rounded shape, parabolic, elliptical, other regular shapes, or it may be an irregular shape or have an exterior sheath configuration specifically designed for the human ear or even for the ear of one or specific individuals. As used herein, the term "exterior sheath configuration" encompasses any shape of the exterior of the sheath, provided that it is dimensioned and configured for comfortable use and suspension of the wireless headset by means of frictional forces between ear canal and sheath. Thus, placed into the ear, sheath 4 generates sufficient frictional forces to hold the small weight of wireless headset 2 in proper position.

In a preferred embodiment, sheath 4 narrows at one end to form a small aperture 26. The narrowing may be in the form of a bevel 34, which terminates in aperture 26. This end of sheath 4 is inserted into the user's ear and thus proximate to the ear drum of the user. At the distal end of sheath 4, sheath 4 has an optional circumferential ridge 32 which adds strength to sheath 4, aids manipulation of sheath 4 by human fingers, and assists in maintaining sheath 4 on the sound tube of wireless headset 2. The size of aperture 26 allows sound transmission between the sound tube and the ear canal. Aperture 26 may be replaced by a pattern of smaller apertures, an aperture having a screen or other members extending across it, and so on.

Sheath 4 is retained by friction on sound tube 22, however, other methods of retention are possible. Mechanical cooperation is also possible between sheath 4 and sound tube 22. For example, a circumferential ridge may extend inwardly towards the longitudinal axis of sheath 4, thus presenting a small detent on the inside of sheath 4. Sound tube 22 may have a corresponding circumferential groove into which the circumferential ridge may fit, providing mechanical cooperation to hold sheath 4 onto sound tube 22. Sheath 4 and sound tube 22 may also be equipped with snaps, belts, fasteners, bumps or similar mechanical structures for holding sheath 4 onto sound tube 22.

Sheath 4 may be made of a compliant polymer or silicon based material. In addition, may equivalent materials may be employed. Any elastomeric, flexible, material may be used: in addition to polymers and silicon based materials, silicon compounds, rubbers, gums, other materials such as gels, soft silicon-like materials, liquids, liquids encased in a compliant shell, and similar materials. In the preferred embodiment, the silicon compound or polymer is a single phase and a single compound/polymer. In alternative embodiments, mixtures of compounds may be used: mixtures of two or more compounds or polymers (including copolymers, multi-polymers). Such compounds and polymers need not be uniphase bodies but may be polyphase foams, either or open or closed cell foams, or may include other material intrusions or cells such as water or other liquids, other solids which enhance material properties by adding or reducing stiffness, plastic memory, ductility and so on. The construction of sheath 4 is thus subject to numerous alternatives, equivalents and substitutions within the scope of the invention as claimed herein.

While frictional forces may be implicated in retaining the wireless headset in the ear of a user in the presently preferred embodiment, in other embodiments, the sheath may be configured so that actual mechanical cooperation between the ear canal and the sheath may serve the same purpose, i.e., the convolutions of the ear canal may cooperate with the exterior sheath configuration.

Figure 5:
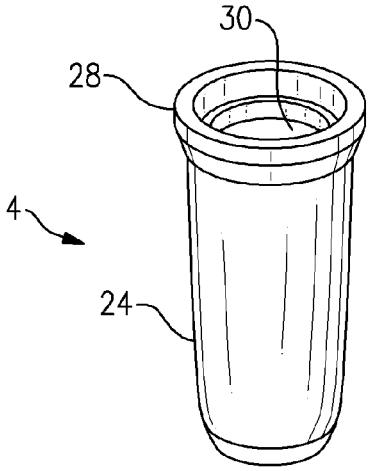
FIG. 5 is a perspective view of the sheath according to a second embodiment of the invention.

Referring to FIG. 5, in a second embodiment of the invention sheath 4 comprises a sheath body 24, a predetermined interior sheath configuration 30, and a circumferential ridge 28 about the open end of sheath body 24. In this embodiment, circumferential ridge 28 is used to aid retention of sheath 4 on sound tube 22 by increasing frictional forces therebetween.

Sheath 4 may be used as a retrofit to increase the comfort of devices not having such a sheath, or it may be used as a replacement when an original sheath wears out and must be replaced. Polymers, particularly relatively flexible polymers, are prone to becoming oxidized and thus replacement will increase the life span of wireless headsets and the like.

There are additional very significant advantages to removable and replaceable sheath 4. A device using sheath 4 may be used by more than one individual without the unpleasant and unsanitary necessity of inserting the same contact surface into the ears of different individuals. A first user may use a first sheath 4, while a second user might use a second sheath 4 when the device is exchanged from one user's ear to the other's ear. By this means there is no chance of transmission of biological materials from ear to ear, and potential squeamishness of multiple users is averted.

Another important advantage of the present invention relates to user comfort. Different people have differing ear canals, meaning that a device comfortable in one person's ear canal might not be comfortably suspended in the ear canal of another. If the second user's ear canal is smaller than the size most comfortably used with a first sheath, the wireless or other device might cause pain when inserted into the ear. If the later user's ear canal is larger, however, the fit will be loose and the device might fall out. Ear canals also vary in configuration, meaning that sheaths may be provided according to the second embodiment of the invention in different exterior sheath configurations. The term "configuration" as used herein encompass the concepts of shape, size, modulus of elasticity, Young's modulus, flexibility, hardness, size of apertures and so on are all included.

Similarly, interior sheath configuration 30 may vary in order to fit sound tube 22 upon which it will be placed. Active tense placement of sheath 4 onto sound tube 22, and passive tense location of sheath 4 on sound tube 22, are both referred to herein as "disposal" on the sound tube, and actively taking sheath 4 off of the sound tube (and sheath 4 being found off of a sound tube) are referred to as "removal" from the sound tube.

Figure 6:
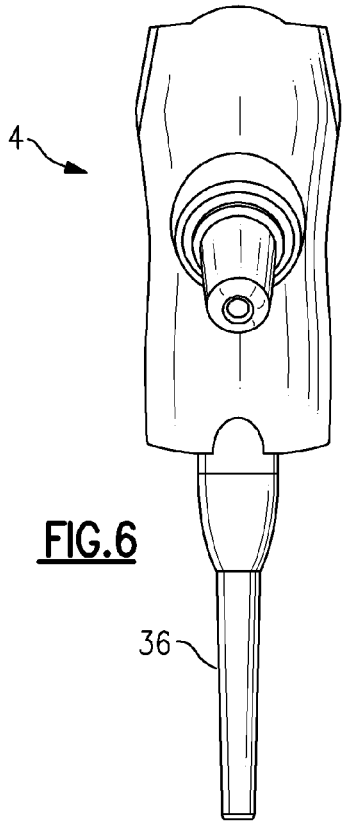
FIG. 6 a bottom view of a third embodiment of the invention.

Referring to FIG. 6, an optional antenna casing 36 may be employed. By this means, both radio reception of the wireless headset device and transmission to a base station in embodiments having such may be dramatically improved. Antenna casing 36 may also serve double duty as an optional microphone tube extending towards the mouth of the user and thus providing better audio reception of the voice of the user. Antenna casing 36 may be a removable and replaceable device which the user may remove and replace as desired. In such alternative embodiments, the device may be used either with the antenna casing 36 on the device, or the wireless headset device may be used without the antenna casing 36.

Figure 7:
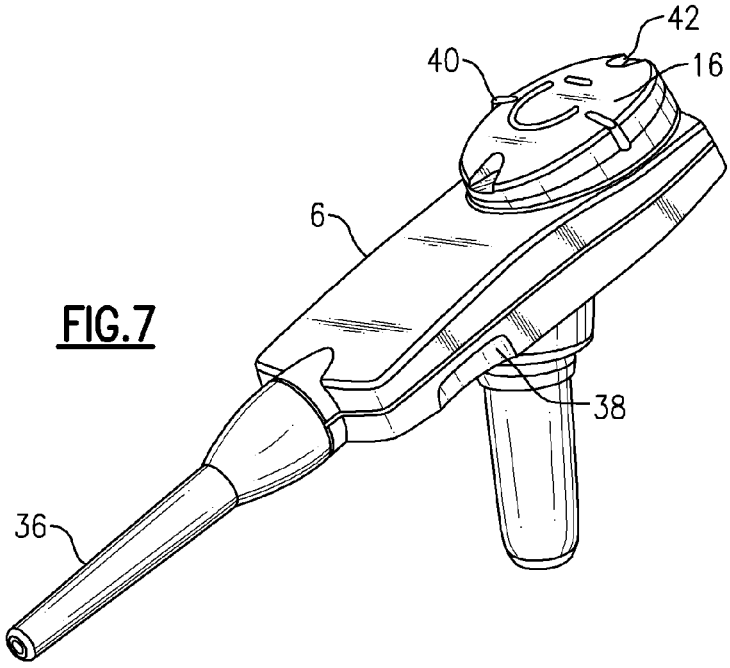
FIG. 7 is a perspective view of a fourth embodiment of the invention.

Referring to FIG. 7, headset body 6 of wireless headset 2 may include one or more grips 38 allowing easier manipulation by the user. Headset 2 may also include cap 16 provided with a knurl 40 that aids the user in removing and replacing cap 16 when replacing battery 14. Cap 16 may also be provided with an indentation 42 to aid in retention of battery 14 on the inside of headset body 6. Cap 16 having indentations 42 or knurls allows easier removal and replacement of the battery cap, thereby allowing easier removal and replacement of the battery.

In use, sound tube 22 with sheath 4 disposed thereon is inserted into an ear of the user. A microphone positioned at the lower end of the headset 2 picks up the user's voice for transmission via circuitry 12 to a base unit connected to a cell phone, ordinary phone or equivalent device. A receiver in circuitry 12 in turn picks up transmissions from the base unit and converts them to audio using mini-speaker 20 located at the base of sound tube 22. Sound from mini-speaker 22 travels through sound tube 22, out of sound tube 22, out of sheath aperture 26, and to the ear canal of the user. Should another user desire to use the device, the user may remove it from their ear canal, remove sheath 4, and hand it to the other user, who may then use their own sheath 4 on it. Polymer sheaths of different sizes than that listed above may be provided for different individuals.

Figure 8:
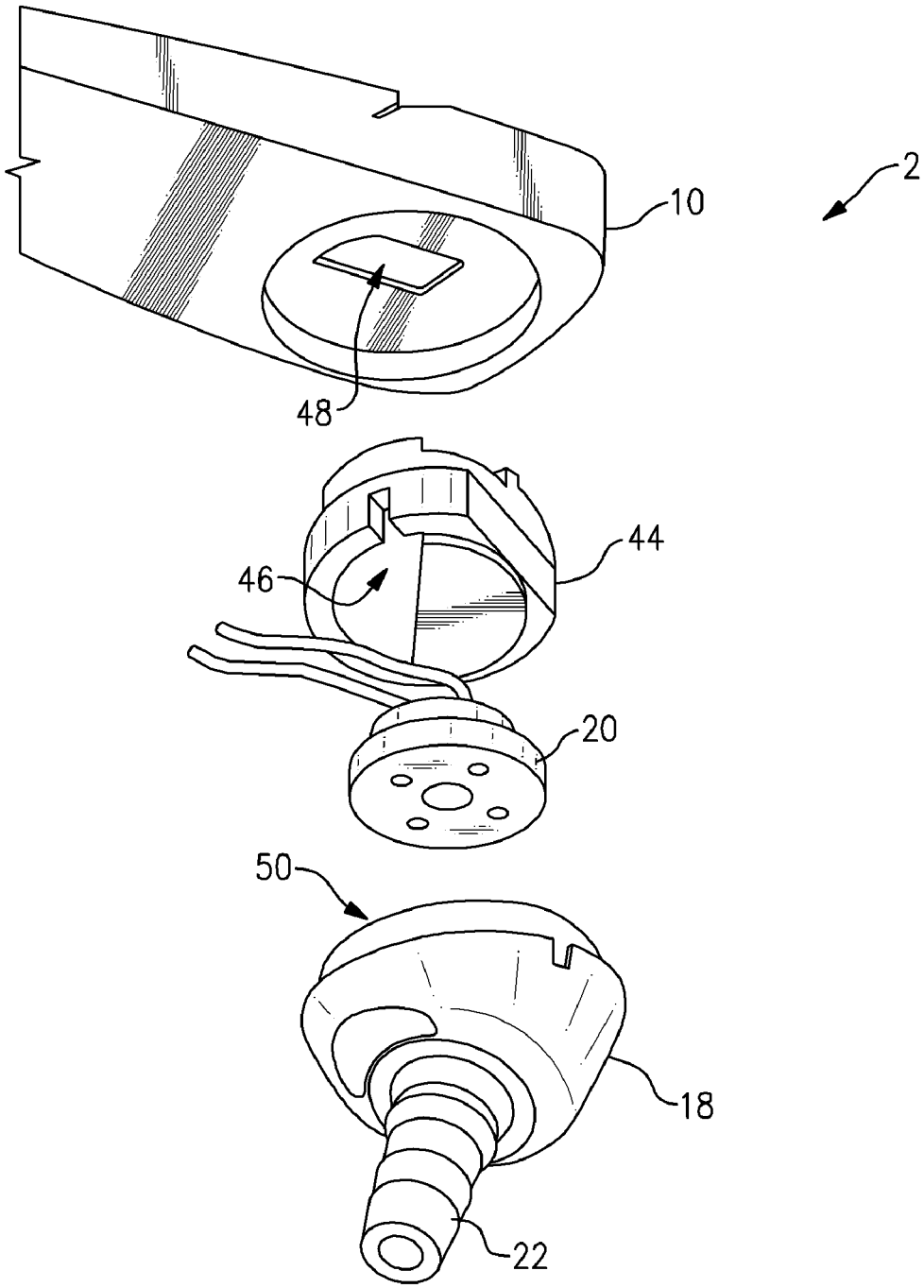
FIG. 8 is an exploded perspective view of a fifth embodiment of the invention.
Figure 9:
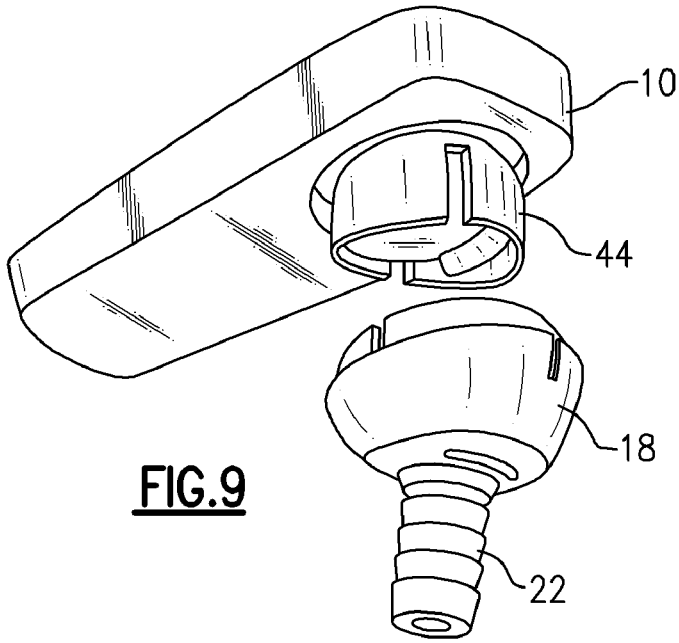
FIG. 9 is an exploded perspective view of a fifth embodiment of the invention.
Figure 10:
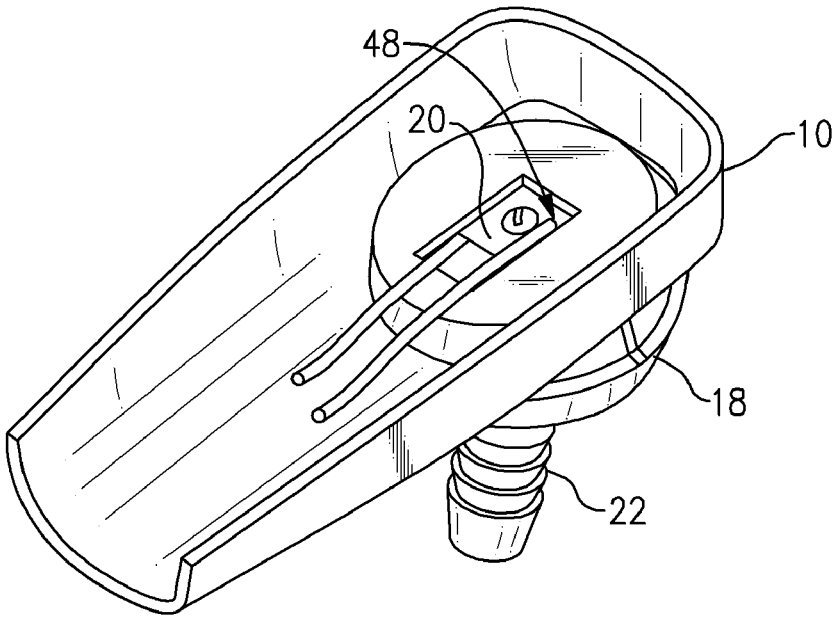
FIG. 10 is a perspective view of a fifth embodiment of the invention.

Referring to FIGS. 8–10, an alternative embodiment of wireless headset 2 including an articulating ball-and-socket type joint for allowing nearly hemispherical motion of sound tube 22 (and thus sheath 4) relative to lower body 10. A resilient hollow ball 44 having an opening 46 formed entirely therethrough is fixedly attached to lower body 10 via conventional means such as sonic welding and extends outwardly from body 10 along a longitudinal axis. Ball 44 is preferably spherical and formed of a resilient material, and may include longitudinal slots formed therein for assisting in resilient expansion and contraction. Lower body 10 includes a port 48 that aligns with opening 46 and provided access to the interior of headset 2 when ball 44 is attached to lower body 10. Ball 44 is sized to house mini-speaker 20 therein and is adapted for pivotal interconnection to speaker housing 18.

As seen in FIGS. 9 and 10, speaker housing 18 includes an at least partially spherical cavity 50 formed therein which acts as a socket for accepting ball 44. Housing 18 is snap engaged over ball 44, thereby forming a ball-and-socket type joint and allowing for movement of sound tube 22 relative to lower body 10. As seen in FIG. 10, through opening 46 formed in ball stud 44 and port 46 of lower body 10 allow mini-speaker 20 positioned in ball 44 to be electrically interconnected to circuitry of headset 2. It should be recognized by those of ordinary skill in the art that the relative dimensioning of ball 44 and housing 18, as well as the resiliency of their respective materials of manufacture and the size of any slots formed therein, will control the relative ease of movement and force required to engage or disengage ball 44 and housing 18.

In addition to provided for movement of housing 18 and sound tube 22 relative to lower body 10, this embodiment of the present invention allows speaker housing 18 and sound tube 22 to be easily attached to or removed from ball 44. As a result, a user may easily replace speaker housing 18 and sound tube 22, or interchange with any parts including a socket dimensioned for snap engagement with ball 44. For example, a user may replace speaker housing 18 and sound tube 22 with a differently sized housing 18 and sound tube, or with a conventional ear bud interconnected to a socket that will mate with ball 44.

What is claimed is:

1. A wireless headset device adapted for positioning in a wearer's ear canal, comprising:

a. a body having a first surface;

b. an elongated sound tube having a first predetermined length the majority of which is adapted for insertion into the wearer's ear and a predetermined cross-sectional dimension that is smaller than said first predetermined length, said sound tube extending outwardly from said first surface and along a first longitudinal axis, wherein said sound tube is pivotally attached to said body by a ball-and-socket joint comprising:

a hollow ball fixedly attached to said body and including an opening formed therethrough;

and a speaker housing including inner surface defining a cavity therein, wherein said inner surface is positioned in covering relation to said hollow ball; and c. an elongated sheath having a second predetermined length that is about the same as the first predetermined length, said sheath being releasably attached to said sound tube and extending co-linearly therewith, said sheath having a predetermined exterior dimension sufficient for frictionally engaging the canal of the wearer's ear, whereby said frictional engagement securely retains said sheath in said ear canal and the headset device in proximity to the wearer's ear.

2. The device of claim 1, wherein said hollow ball includes longitudinal slots formed therein.

3. The device of claim 1, wherein a speaker is positioned within said hollow ball and said speaker housing.

4. The device of claim 1, further comprising circuitry housed in said body for transmitting and receiving signals.

5. The device of claim 4, wherein said body includes a port formed therein in alignment with said opening of said hollow ball.

6. The device of claim 5, wherein said speaker is electrically interconnected to said body through said opening in said hollow ball and said port in said body.

7. The device of claim 6, wherein said body further includes a microphone, an antenna, and a battery electrically interconnected to said circuitry.

* * * * *